United States Patent [19]

Bouyoucos

[11] 4,348,943

[45] Sep. 14, 1982

[54] HYDRAULIC PRESS APPARATUS

[75] Inventor: John V. Bouyoucos, Rochester, N.Y.

[73] Assignee: Hydroacoustics Inc., Henrietta, N.Y.

[21] Appl. No.: 144,476

[22] Filed: Apr. 28, 1980

[51] Int. Cl.[3] ..... F15B 11/15; F15B 13/07

[52] U.S. Cl. ..... 91/355; 91/417 R; 91/441; 91/517

[58] Field of Search ..... 91/516, 517, 518, 355, 91/356

[56] References Cited

U.S. PATENT DOCUMENTS

| | | | |
|---|---|---|---|
| 1,922,513 | 8/1933 | Wiedmann | 91/517 |
| 1,955,278 | 4/1934 | Ferris et al. | 91/517 |
| 2,338,350 | 1/1944 | Oberholtzer | 60/430 |
| 2,602,294 | 7/1952 | Sedgwick | 91/518 |
| 2,805,447 | 9/1957 | Voges | 91/404 |
| 2,875,732 | 3/1959 | Hoffman | 91/422 |
| 2,984,981 | 5/1961 | Rowles | 60/371 |
| 3,554,087 | 1/1971 | Florjancic | 91/404 |
| 3,796,050 | 3/1974 | Fisk | 92/134 |
| 3,817,152 | 6/1974 | Viron | 91/517 |
| 3,819,021 | 6/1974 | Schacher et al. | 91/517 |
| 3,922,854 | 12/1975 | Coeurderoy | 60/413 |
| 3,963,039 | 6/1976 | Coeurderoy | 60/413 |
| 4,142,368 | 3/1979 | Mantegani | 60/413 |

FOREIGN PATENT DOCUMENTS

| | | | |
|---|---|---|---|
| 657672 | 9/1951 | United Kingdom | 91/517 |

*Primary Examiner*—Paul E. Maslousky

*Attorney, Agent, or Firm*—Martin Lukacher

[57] ABSTRACT

A fast acting hydraulically actuated ram (10) especially suitable for use in the punch head of a press uses a first ram area (28) to advance the ram until the load thereon increases, which occurs when punching is about to take place. Then a pressure actuated valve (22), which is responsive to the increase in hydraulic pressure acting upon the first ram area, places pressure on a large area (36) of the ram for a time sufficient to enable penetration of the work. An electrohydraulically controlled valve (20, 98) responsive to the ram position, switches hydraulic pressure which is applied to the first ram area so as to operate the ram under electrical control to provide the desired cycle time and frequency.

21 Claims, 3 Drawing Figures

HYDRAULIC PRESS APPARATUS

DESCRIPTION

The present invention relates to hydraulic actuators and particularly to hydraulic press apparatus which utilizes hydraulic power to provide mechanical force for punching, pressing, extrusion and other industrial applications.

The invention is especially suitable for use in automatically operated hydraulic punch heads in which a large force is required to punch through the work piece, but only over a small portion of the forward stroke of the cycle of motion of the punch head. This cycle includes the forward stroke or advance and the return or retract stroke of the head, over most of which only low force level motion is needed to advance the ram and strip the work piece. The invention is generally applicable to hydraulic actuators for providing a strong force boost when needed.

Punch apparatus which is generally in use in industry has a mechanical system for actuating the ram in the punch head. The mechanical system may have a slider crank mechanism which provides increased punching force at the end of the stroke so as to penetrate the work piece. Such mechanical systems are limited in performance, both in punch cycle time and in frequency. A large force is required to punch through the work piece, but this force requirement occurs over a very small portion of the cycle. In order to provide power and energy efficient apparatus, it is desirable to provide for low force level motion over most of the advance and all of the retract stroke of the cycle with a strong force boost to penetrate through the work piece only when needed. The stroke desirably should be held to close tolerances, especially at the bottom, and sufficient force should be applied during the return stroke to strip the work piece.

Automation of the punching cycle is also desirable. Electrical control from a controller, such as a computer controller, is preferable. Air punching (no load—as when the work piece is not inserted under the punch) must be accommodated without damage to the punch or overheating. In order to minimize wear, velocities of moving parts should be maintained as low as practicably, commensurate with punching cycle time requirements.

Hydraulic systems which provide shorter cycle time and higher frequencies than mechanical systems, while meeting other requirements necessary or desirable for punch system operation, have not been available. Such hydraulic mechanisms as have been suggested for boosting force have involved multiple pumps and complex hydraulic circuits (see U.S. Pat. No. 2,338,350) or special ram construction together with complex hydraulic circuits for their operation (see U.S. Pat. No. 2,805,447).

Accordingly, it is an object of the present invention to provide improved hydraulic press apparatus which meets the foregoing requirements economically and efficiently.

Another object of the invention is to provide an improved hydraulic actuator which affords a boost force automatically to accommodate an increase in load and which may be implemented and controlled simply and conveniently.

It is a further object to the present invention to provide improved hydraulic press apparatus which is operable under electric signal control and permits rapid operation and precise cycle control.

It is a still further object of the present invention to provide improved hydraulic press apparatus which develops high forces when needed during a cycle of operation.

Briefly described, hydraulic press apparatus embodying the invention uses a ram which may carry a die or other tool for applying force to a work piece. The ram executes forward and return strokes as it reciprocates in a cylinder toward and away from the work piece. The ram has first and second opposed areas which define first and second chambers in the cylinder. The ram also has a third area opposed to the second area which defines a third chamber in the cylinder. The third area may be larger than the first or second areas. A pump supplies hydraulic fluid at relatively high (supply) and at relatively low (return) pressures to the chambers via first and second valves. The first valve may be electrohydraulically actuated in response to control signals, as from an external controller and also from a sensor which is responsive to the position or displacement of the ram. The first valve switches pressure to the first cavity and may also switch pressure to the second cavity, although the second cavity may be maintained continuously at supply pressure, in which case the difference in the first and second areas provides for a net upward force on the ram to effect the return stroke thereof, when the pressure in the first cavity is switched to return pressure. The second valve is responsive to the pressure in the first chamber and is actuated when the pressure therein increases to a predetermined pressure, which occurs when increased force is necessary, as when penetrating the work piece during punching a operation. The second valve switches the pressure in the third cavity to full supply pressure so as to boost the force applied by the ram to the work piece, when needed. The second valve automatically returns and disconnects the applied pressure from the third chamber when the load decreases in response to a decrease in pressure in the first chamber. This occurs after the work is penetrated. Then the retracting force is applied to the ram so as to enable the work to be stripped.

The foregoing and other objects, features and advantages of the invention, as well as presently preferred embodiments thereof, will become more apparent from a reading of the following description in connection with the accompanying drawings in which.

Figure 2:
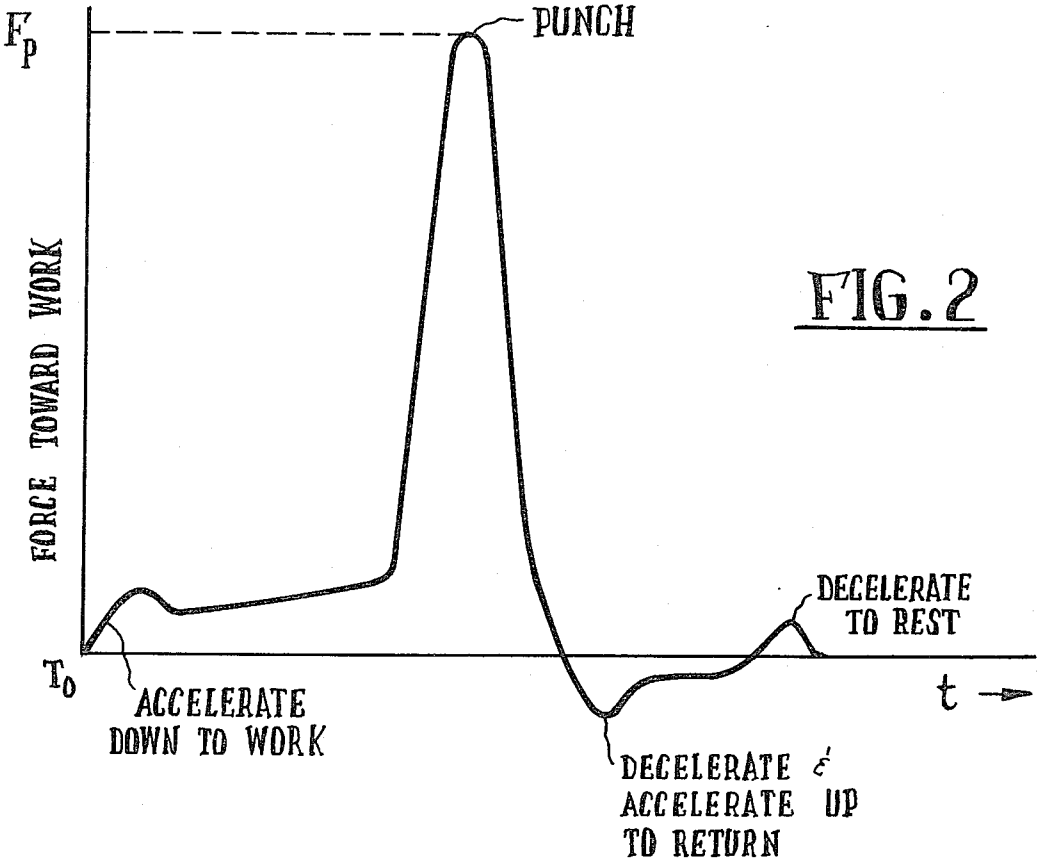
FIG. 2 is a curve illustrating the force applied by the ram of the press apparatus shown in FIG. 1 during a cycle of operation thereof.

Referring first to FIG. 2 there is shown a typical cycle of a hydraulic punch apparatus or engine which may be obtained with the invention. The ordinate of the curve shows the force toward the work, and the abcissa represents the time of the cycle. The maximum force level, which may for example be 10 to 50 tons, is obtained during punching and only in a short portion of the forward stroke. Much less force level is applied to advance the ram on the forward stroke and to retract the ram during the return stroke. The force is negative (below the abcissa) during the return stroke and while the ram is decelerated at the end of the forward stroke. The advancing and retracting forces may be much less than the maximum force which is applied during the punching of the work. At the beginning of the cycle the ram is accelerated down towards the work. Upon the work being engaged, the force is boosted automatically by operation of the apparatus as the work piece is encountered. After punching the force decreases and the ram is decelerated and accelerated upwardly to complete the return stroke. The stroke is held within a close tolerances automatically by operation of the apparatus. The return stroke is positive with sufficient force to strip the tool or die of the punch from the workpiece. A slight downward force to decelerate the ram to rest may also be applied. Short punch cycle time may be obtained.

Figure 1:
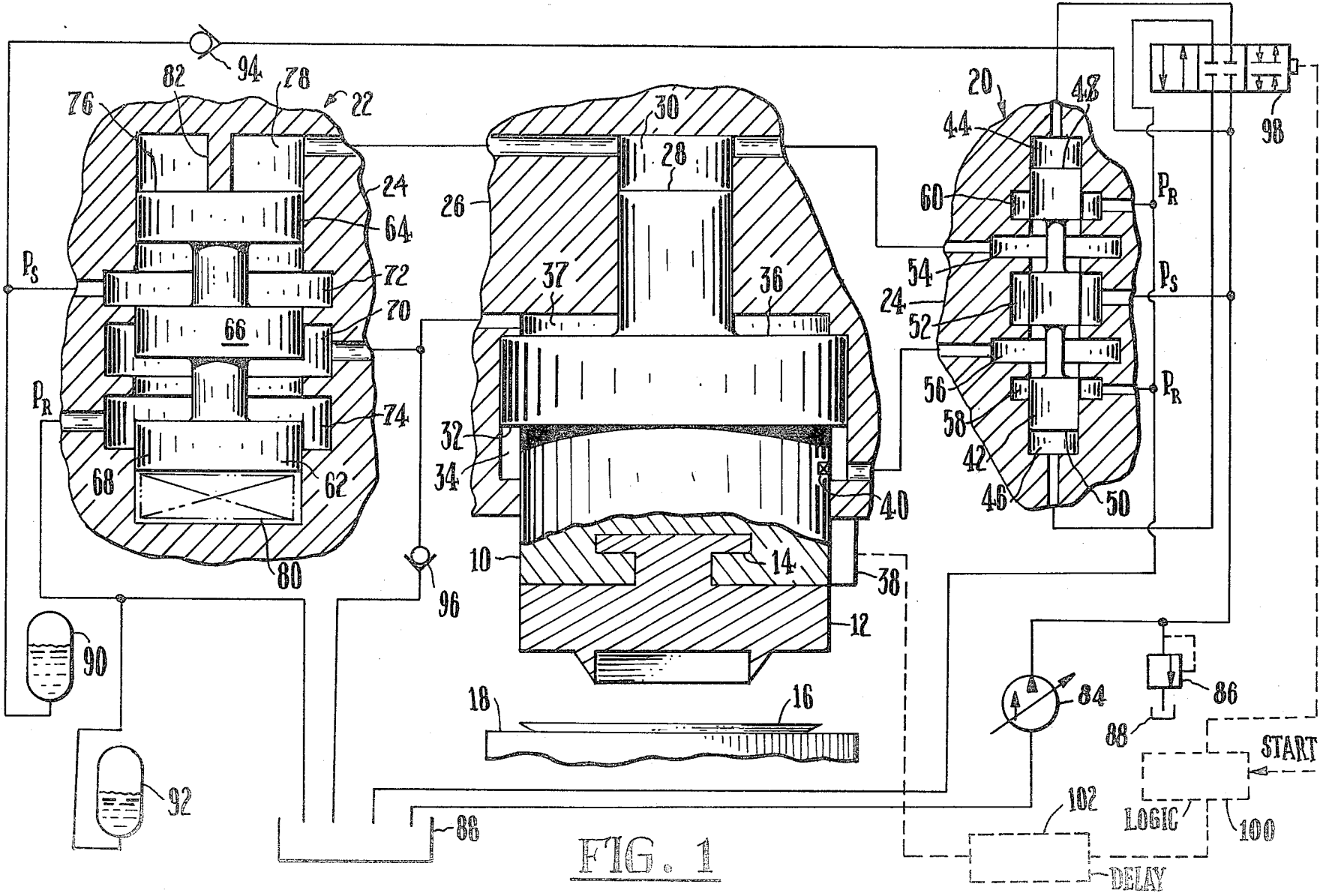
FIG. 1 is a simplified cross-sectional view of the ram and valves and a schematic diagram of the hydraulic circuits associated therewith in hydraulic press apparatus in accordance with an embodiment of the invention.

Referring to FIG. 1, the ram 10 of the hydraulic press may receive a tool or die held by insertion into a slot 14 at the bottom end thereof. A hole punching die is illustrated which punches a workpiece 16 which is disposed on a platen 18 under the ram 10. First and second valves 20 and 22 may be mounted in the same punch head as the ram 10 or in separate housings or cylinders 24, 26 and 28, as shown diagrammatically in the drawing. The terms "housing" and "cylinder" are synonymous as used herein.

The ram 10 is a cylindrical member axially moveable in the cylinder 26. It has a first pressure area 28 at the upper end thereof. This pressure area or surface 28 defines a first chamber 30 in the cylinder 26. A second pressure area or surface 32, opposed to the pressure area 28, is defined by a step in the ram on the bottom of the head or piston ring portion thereof. The second pressure area 32 defines a second chamber 34 in the cylinder. In this embodiment of the invention the areas 28 and 32 may be equal to each other and approximately 10% of a third pressure area 36 on the top side of the piston or head portion of the ram 10. The third area 36 defines a third chamber 37 in the cylinder 26. The sizes of these areas and the size of the ram depends upon the forces which are to be developed by the ram and by losses, which may be manifested as pressure drops in the hydraulic lines and in the valves of the apparatus.

Also mounted on the cylinder 26 is a sensor 38 which is responsive to the position of the ram 10 and provides signals as the ram approaches the bottom of the forward stroke and the top of the return stroke. This sensor may contain a magnetic pickup which senses the field of a magnet 40 on the ram 10.

The first valve 20, which is also referred to as the control valve, is a four-way valve having a spool 42 with three lands or heads. The valve 20 is hydraulically controlled in response to hydraulic pressure in chambers 44 and 46 defined by surfaces 48 and 50 at the opposite ends thereof. This valve 20 has three positions or states. In the center position or state the valve is closed. When the valve spool 42 is shifted downwardly, the center cavity 52 is connected to its adjacent cavity 54 and the lower two cavities 56 and 58 are also connected. By shifting the valve spool 42 upwardly, the center cavity 52 and the cavity 56 below it are connected and the upper cavity 60 is connected to its next lower cavity 54.

The second valve 22 is a three-way valve having a spool 62 which is axially moveable in the cylinder 28. Spool 62 has three lands or heads 64, 66 and 68 which support and selectively interconnect a center cavity 70 with upper and lower cavities 72 and 74. The upper end of the spool 62 has a pressure surface 76 which defines a control chamber 78 in the cylinder 28. The spool 62 is biased upwardly by suitable biasing means, such as a spring 80 which applies a predetermined force to the spool 62. This force is related to the force which is developed in the control chamber 78 when the ram encounters the load (viz., when the die 12 requires a boost in force—the punching force—to penetrate the workpiece 16). The displacement of the spool 62 in the upward direction is limited by a stop 82 which may be a boss extending downward from the top of the cylinder 28. Alternatively, the spool may be extended so as to provide a stop when it engages the top of the cylinder. Such an extension **82*a* is used in the second valve 22*a* in the embodiment of the invention illustrated in FIG. 3. The second valve 22 may be referred to as the boost valve since it is operative to supply hydraulic fluid for boosting the force developed by the ram during penetration of the workpiece 16**.

In order that the rate of movement of the ram 10 not be limited by the rate of movement of the boost valve 22, the area of the pressure surface 76 of the boost valve spool 62 is desirably sized such that the spool 62 translates downwardly against the bias of the spring 80 with a velocity much higher than the velocity of the ram 10 in the down stroke direction. Suitably, the pressure area 76 should be approximately 20% of the pressure area 28 at the upper end of the ram 10. Then, the movement of the boost valve spool 62 will be such that the flow therethrough is not limited by the rate of movement thereof, and the ram may translate at its maximum rate commensurate with the flow available to the pressure surfaces 28 and 36 thereof.

Pressurized hydraulic fluid is provided to the apparatus by a pump 84. This pump is desirably a variable volume, pressure compensated pump. Pressure compensation may be provided by a relief valve 86 which allows excess flow to return to the reservoir 88 (shown in two places in FIG. 1 to simplify the illustration). The output of the pump is at relatively high Pressure, $P_S$ with the reservoir being at relatively low pressure, $P_R$. Accumulators 90 and 92 are connected to the pump and to the reservoir and are closely coupled to the supply and return pressure inputs of the boost valve 22. These accumulators contain hydraulic fluid (oil) and gas under pressure on opposite sides of a diaphragm or a piston therein. The high pressure accumulator 90 is connected to the pump via a check valve 94. The third or boost chamber 37 defined by the pressure surface 36 of the ram is connected to the center cavity 70 of the boost valve 22 and also to the reservoir 88 via another check valve 96.

The center cavity 52 of the control valve 20 is connected to the supply side of the pump while the end cavities 58 and 60 are connected to return (that is to the reservoir 88). The outputs of the control valve 22 from the output cavities 54 and 56 are respectively connected to the upper chamber 30 and the lower chamber 34 of the ram. The upper chamber 30 of the ram is also connected to the control chamber 78 of the boost valve 22.

An electrically operated three-position valve 98 is connected to a logic circuit 100. The logic circuit also receives electrical inputs through an optional delay circuit 102 from the sensor 38. The hydraulic fluid at supply and return pressure flows through the valve 98 to the control cavities 44 and 46 of the valve. At the beginning of the cycle (viz., at the top of the return stroke), the valve 98 is in the position shown in the drawing and the control cavities 44 and 46 of the control valve 20 are sealed; the control valve 20 then being in the position shown in the drawing. The pressurized fluid contained in the ram chambers 30, 34 and 37 maintain the ram in position at the top of the stroke ready for a punch cycle.

To start the advance or downstroke, the start signal activates the valve 98 from its center position (as shown in the drawing to the right). The spool 42 of the control valve 20 is shifted downward, supplying flow from the pump 84 to the upper chamber 30 of the ram cylinder and from the lower chamber 34 to the reservoir 88. As the volume of the boost ram chamber 37 increases, it is supplied with fluid at return pressure via the check valve 96. The advance of the ram 10 is controlled by the flow metered through the control valve 20. The pressure in the upper chamber 30 remains substantially below supply pressure until the die 12 reaches the workpiece 16 and the load on the ram increases.

When the die 12 is in contact with the workpiece 16, the pressure in the upper chamber 30 increases. As the pressure rises to a predetermined pressure, for example, 75% of the nominal pressure, $P_S$, the pressure in the control chamber 78 of the boost valve 22 exceeds a certain magnitude which causes the spool 62 of the valve 22 to shift downwardly against the bias of the spring 80. Hydraulic fluid at supply pressure passes from the high pressure accumulator 90, through the cavities 72 and 70 of the boost valve cylinder 28, to the boost chamber 37. This provides the necessary force boost to maintain the motion of the ram and to punch through the workpiece 16.

As the load drops off (the die 12 penetrating the workpiece 16), the pressure in the ram chamber 30 decreases, as does the pressure in the control chamber 78 of the boost valve 22. The spring 80 then returns the boost valve spool 62 to the position shown in the drawing. The high force $F_P$, as shown in FIG. 2, is then obtained for the time necessary to punch through the workpiece 16.

Shortly before the ram reaches its bottom position, at the bottom of the forward stroke, the sensor 38 provides an output signal to the logic circuit 100. This signal may be delayed by the delay circuit 102, which is optional since the requisite delay may be obtained by positioning the sensor 38. However, an electrical delay is easier to control and is preferably used. The logic circuit 100 provides an operating electrical signal to the valve 98 to shift the valve to the left. The pressure in the control cavities 44 and 46 of the control valve 20 is then switched, such that the spool 42 thereof moves upwardly to connect supply pressure to the lower chamber 34 and return pressure to the upper chamber 30 of the ram. Such switching may occur before the end of the forward stroke so that the ram decelerates before accelerating upwardly along the return stroke. The force applied in the upward direction serves to strip the workpiece 16 from the die 12.

As the ram reaches the top of the return stroke, another signal from the sensor 38 serves to switch the valve 98 to the right and then back to center position so as to decelerate the ram to rest at the top of the return stroke. Conventional time delay circuits, e.g., counters, gates and flip-flop may be used in the logic circuit 100 to obtain the foregoing control signals to the valve 98. An electrically operated valve (not shown) operated by a signal from the logic circuit 100 may connect the upper cavity 30 to return (the reservoir 88) at the end of the return stroke to avoid any tendency for the boost valve 22 to be activated at the end of the return stroke.

In the event of "air punching", where no workpiece 16 is inserted on the platen 18, the above discussed increase in load on the ram does not take place. Consequently, the pressure in the upper chamber 30 and in the control chamber 78 of the valve 22 does not increase. The spool 62 of the boost valve 22 does not shift but remains in its upper position, as shown in the drawing. Another electrically operated valve, operated from the logic circuit, may be used to avoid any tendency for the boost valve 22 to be operated at the bottom of the forward stroke of the ram. Also when the ram 10 reaches the top of its return stroke, the pump pressure is greater than the pressure remaining in the high pressure accumulator 90. The check valve 94 then allows flow from the pump 84 to replenish the high pressure accumulator 90 before the beginning of the next cycle. When the accumulator 90 is fully charged the, relief valve 86 allows the excess flow to return to the reservoir 88.

It will be observed that all of the moving parts of the system are lubricated by the operating fluid (the hydraulic oil). Heat is removed by the fluid to the reservoir 88 where it can readily dissipate. The low value of compressibility of the fluid permits rapid operation and precise cycle control.

Figure 3:
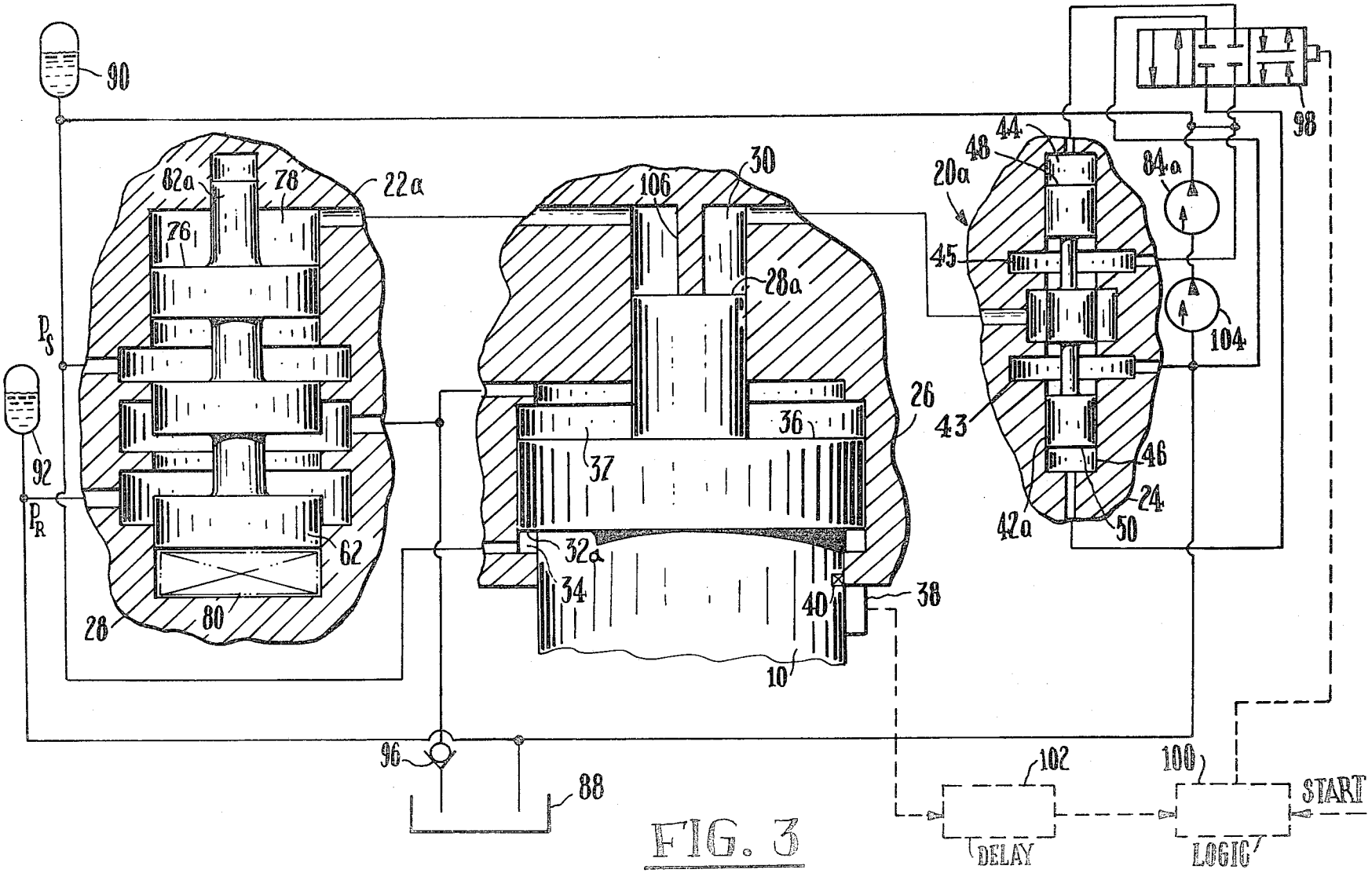
FIG. 3 is a diagram similar to FIG. 1 showing hydraulic press apparatus in accordance with another embodiment of the invention.

Referring next to FIG. 3, hydraulic press apparatus is illustrated in which parts similar to those to the apparatus shown in FIG. 1 are labeled with like reference numerals. The pressurized fluid is supplied to the apparatus by a high pressure pump **84*a* and a charge pump 104. The control valve 20*a* is a three-position, three-way valve which closes the control chamber 30 of the ram cylinder 26, supplies fluid at supply pressure thereto, or supplies fluid at return pressure thereto. Supply pressure is continuously supplied to the lower chamber 34 from the pumps 84*a* and 104. The pressure area 28*a* is larger than the pressure area 32*a* such that when the fluid at supply pressure is supplied to the upper chamber 30 during the advance stroke, the net force on the ram is downwardly and the ram moves toward the workpiece (not shown in FIG. 3). On the return stroke, the upper chamber 30 is connected through the control valve 20*a* to the return side of the pump 84*a*. Accordingly, the net force on the ram 10 is in the upward direction. A stop 106 may be provided at the top of the ram cylinder 26 if desired. The apparatus shown in FIG. 3 otherwise operates in exactly the same way as described above in connection with FIG. 1**.

From the foregoing description it will be apparent that there has been provided an improved hydraulic system and especially an improved hydraulic actuator and press apparatus. Variations and modifications in the herein described apparatus will undoubtedly suggest themselves to those skilled in the art. Accordingly, the foregoing description should be taken as illustrative and not in a limiting sense.

I claim:

1. Hydraulic press apparatus which comprises a ram for applying force to a workpiece, a cylinder in which said ram is moveable along forward and return strokes toward and away from the workpiece, said ram having first and second opposed areas which define first and second chambers in said cylinder, said ram also having a third area opposed to said second area which defines a third chamber in said cylinder, said third area being larger than said first or second areas, means for providing hydraulic fluid at relatively high pressure and for providing hydraulic fluid at relatively low pressure, a first valve means for alternately supplying said hydraulic fluid from said providing means at high and low pressure to said first chamber to move said ram along its forward and return strokes respectively, said second chamber being supplied with said hydraulic fluid at said high pressure at least during said return stroke, a second valve, said first valve being connected between said providing means and said first chamber via connections for hydraulic fluid flow therebetween, said second valve being connected between said providing means and said third chamber via connections for hydraulic fluid flow therebetween, said first and second valves producing flow of said fluid at said high pressure into said first chamber and flow of said fluid at said low pressure into said third chamber to enable movement of said ram along said forward stroke, said second valve having hydraulic pressure responsive means for operating said valve to move at a velocity greater than said ram, said first chamber being connected to said second valve for supplying fluid from said first chamber to said pressure responsive means to operate such second valve when the pressure in said first chamber exceeds a certain magnitude during the portion of said forward strokes when said force is applied to said workpiece for supplying said third chamber with said high pressure fluid thereby increasing the force applied to said ram against said workpiece and also to provide for a short operating cycle for said press apparatus.

2. The invention as set forth in claim 1 wherein said first valve means for supplying hydraulic fluid alternately from said high and low pressure providing means to said first chamber is via said connection between said first valve and said first chamber.

3. The invention as set forth in claim 2 wherein said first area is larger than said second area, and said providing means and said second chamber being connected to supply said hydraulic fluid at high pressure continuously to said second chamber during both said forward and return strokes.

4. The invention as set forth in claims 2 or 3 further comprising means responsive to the position of said ram for operating said first valve to switch the supply of said hydraulic fluid to said first chamber from said high to low pressure providing means when said ram is displaced a predetermined distance from the bottom of its forward stroke.

5. The invention as set forth in claim 2 further comprising a connection between said first valve and said second chamber, said first valve having means for supplying hydraulic fluid from said high pressure providing means to said second chamber when it supplies hydraulic fluid from said low pressure providing means to said first chamber and from said low pressure providing means to said second chamber when it supplies hydraulic fluid from said high pressure providing means to said first chamber.

6. The invention as set forth in claim 1 wherein said providing means comprises at least one pump for supplying said hydraulic fluid at substantially constant pressure.

7. The invention as set forth in claim 6 wherein accumulators are connected in closely coupled relationship to said second valve between said pump and said second valve for tending to maintain said high and low pressures substantially constant.

8. The invention as set forth in claim 1 wherein said second valve has a spool in a cylinder biased in one direction, said spool having an area defining a control chamber in said cylinder for developing forces on said spool in a direction opposite to said one direction in response to the pressure of said hydraulic fluid in said control chamber, said first chamber being connected to said control chamber for operating said second valve to supply said high pressure fluid to said third chamber via said second valve when said pressure in said third chamber reaches said predetermined pressure.

9. The invention as set forth in claim 8 wherein said second valve hydraulic pressure responsive means for operating said second valve to move at a velocity greater than said ram comprises said spool area being of such size relative to said first area that said spool is shifted in said opposite direction faster than said ram is shifted in said forward direction in response to said high hydraulic pressure in said first chamber.

10. The invention as set forth in claim 8 wherein said spool area is approximately 20% of said first area.

11. The invention as set forth in claim 8 wherein said spool has a second spool area opposed to said first named spool area, means for continuously applying force to said second spool area to bias said spool in said one direction.

12. The invention as set forth in claim 11 wherein said force applying means is a spring between said second spool area and the end of said cylinder opposite to said second spool area.

13. The invention as set forth in claim 12 wherein said second valve is a three-way valve for supplying hydraulic fluid at said low pressure to said third chamber until said spool is shifted in said opposite direction and for supplying said fluid to said third chamber at said high pressure when said spool is shifted in said opposite direction.

14. The invention as set forth in claim 13 wherein said first and second areas are equal in size and said first valve is a four-way valve having three positions for supplying said hydraulic fluid from high pressure providing means to said first chamber and from low pressure providing means to said second chamber and vice versa when in a first and a second of said positions thereof and for closing said first and second chambers in a third of said positions thereof.

15. The invention as set forth in claim 13 wherein said first area is larger than said second area, a connection from said high pressure providing means to said second chamber for continuously supplying hydraulic fluid at said high pressure thereto, and said first valve is a three-way valve having three positions for alternatively supplying hydraulic fluid from said high and low pressure providing means in a first and second of said three positions to said first chamber and for closing said first chamber when in said third position.

16. The invention as set forth in claims 14 or 15 wherein said first valve has a spool shiftable in a cylinder and having opposed areas defining first and second control chambers, means including a control valve responsive to the position of said ram for applying pressurized hydraulic fluid to said control chambers to shift said spool selectively into different ones of said positions to supply hydraulic fluid to the chambers of said ram cylinder for accelerating said ram along the said forward stroke towards said workpiece, decelerating said ram at the bottom of its said forward stroke and to decelerate and accelerate said ram to stop at the end of its said return stroke.

17. The invention as set forth in claim 13 further comprising a check valve for supplying hydraulic fluid to said third chamber when said pressure therein is less than said low pressure.

18. The invention as set forth in claim 13 further comprising an accumulator connected to said three-way valve at the high pressure input thereof, and a check valve connected to supply said hydraulic fluid to said accumulator from said providing means when the pressure of said fluid therein is less than said high pressure.

19. A hydraulic actuator which comprises a piston having first and second actuating surfaces defining first and second chambers, said second actuating surface being larger than said first surface, a source of pressurized hydraulic fluid, a pressure actuated valve having an actuating surface defining a control chamber, said valve actuating surfaces being in such size relationship to said first surface that said valve movement is faster than said piston movement when the valve is actuated, a connection for the flow of hydraulic fluid between said first chamber and said control chamber, a connection for said pressurized hydraulic fluid from said source to said first chamber, and a connection from said source via said valve for said pressurized hydraulic fluid to said second chamber which is provided when said valve is actuated in response to a predetermined pressure of said fluid in said first chamber which is communicated to said control chamber via said connection there between, for boosting the hydraulic actuating force on said piston and decreasing the duration of the operating cycle of said actuator.

20. The invention as set forth in claim 19 wherein said piston has a third surface opposed to said first and second surfaces and smaller than said second surface in area, said third surface defining a third chamber, and a hydraulic connection to said third chamber for applying said fluid at high pressure to obtain a return stroke of said piston.

21. The invention as set forth in claim 20 further comprising electrohydraulic control valve means responsive to the position of said piston for selectively switching the pressure in at least said first chamber from relatively high to relatively low pressure to obtain a cycle of movement of said piston of predetermined stroke length.

* * * * *